US009370242B2

(12) United States Patent
Guizzardi

(10) Patent No.: US 9,370,242 B2
(45) Date of Patent: Jun. 21, 2016

(54) KIT FOR ASSEMBLING A SHELF UNIT

(71) Applicant: TERRY STORE-AGE S.p.A., Milan (IT)

(72) Inventor: Massimo Guizzardi, Milan (IT)

(73) Assignee: TERRY STORE-AGE S.P.A., Milan (IT)

( * ) Notice: Subject to any disclaimer, the term of this patent is extended or adjusted under 35 U.S.C. 154(b) by 0 days.

(21) Appl. No.: 14/440,619

(22) PCT Filed: May 26, 2014

(86) PCT No.: PCT/EP2014/060792
§ 371 (c)(1),
(2) Date: May 5, 2015

(87) PCT Pub. No.: WO2015/106837
PCT Pub. Date: Jul. 23, 2015

(65) Prior Publication Data

US 2016/0015174 A1 Jan. 21, 2016

(30) Foreign Application Priority Data

Jan. 14, 2014 (IT) ..... MI20140009 U

(51) Int. Cl.
*A47B 47/00* (2006.01)
*A47B 96/02* (2006.01)
*A47B 87/02* (2006.01)

(52) U.S. Cl.
CPC ..... *A47B 47/0083* (2013.01); *A47B 87/0223* (2013.01); *A47B 96/021* (2013.01); *A47B 96/024* (2013.01)

(58) Field of Classification Search
CPC .. A47B 7/0083; A47B 96/021; A47B 96/024; A47B 87/0223
See application file for complete search history.

(56) References Cited

U.S. PATENT DOCUMENTS 3,986,616 A * 10/1976 Gray ..... A47B 96/021 108/107
4,138,953 A * 2/1979 Tashman ..... A47B 57/265 108/147.13

(Continued)

FOREIGN PATENT DOCUMENTS

DE EP 1033091 A1 * 9/2000 ..... A47B 57/265
EP 1029470 8/2000
GB 2232344 12/1990

OTHER PUBLICATIONS

International Search Report and the Written Opinion dated Aug. 7, 2014, which issued during prosecution of International Application No. PCT/EP2014/060792, which corresponds to the present application.

*Primary Examiner* — Stanton L Krycinski
(74) *Attorney, Agent, or Firm* — Troutman Sanders LLP

(57) ABSTRACT

A shelf unit having at least one metal shelf having at least one through hole, at least one upright made of plastic and comprising at least one male connecting end and at least one female connecting end, coupling with the male connecting end, and at least one plastic insert exhibiting at least one through hole provided with means for engagement with the upright, the first and second parts of the upright can be slipped into the hole of the insert from opposite sides thereof so as to connect them to each other, the insert interlocking in one end of the shelf in which the hole in the insert is aligned with the hole in the shelf and the engagement means can be tightly fastened between the female connecting end and the male connecting end when the first and second parts of the upright are connected to each other.

12 Claims, 9 Drawing Sheets

(56) References Cited

U.S. PATENT DOCUMENTS 4,696,406 A * 9/1987 Karashima ..... A47B 96/021 108/110
4,976,360 A * 12/1990 Zucker ..... A47F 5/0018 108/190
5,947,036 A * 9/1999 Cohen ..... A47B 49/004 108/110
5,964,163 A 10/1999 Cohen
6,202,867 B1 * 3/2001 Di Blasi ..... A47B 47/0075 108/138
8,960,822 B1 * 2/2015 Hsu ..... A47B 88/16 312/334.4
2004/0159622 A1 * 8/2004 Craft ..... A47B 87/0246 211/153
2006/0054063 A1 * 3/2006 Ryan, Jr. ..... A47B 47/0083 108/27
2007/0045209 A1 * 3/2007 Richardson ..... A47B 96/024 211/187
2008/0061019 A1 * 3/2008 Lin ..... A47B 47/0083 211/187

* cited by examiner

KIT FOR ASSEMBLING A SHELF UNIT

CROSS-REFERENCE TO RELATED APPLICATIONS

This application is a National Stage of International Application No. PCT/EP2014/060792 filed May 26, 2014. The International Application claims priority to Italian Application No. MI2014U000009, filed Jan. 14, 2014. The subject matter of the above applications is incorporated herein by reference.

FIELD OF INVENTION

The present invention refers to a kit for assembling a shelf unit.

BACKGROUND

Plastic sectional shelf units comprising plastic shelves and plastic uprights have been present on the market for some time.

The strong point of sectional shelf units made of plastic consists in its simple assembly, as the components are generally directly provided with sections that are specially shaped for interlocking them together.

Moreover, the edges of the components are generally bevelled and thus cannot harm people during assembly or disassembly of the shelf unit, or during normal use of the shelf unit in the case of accidental impact.

At the same time, a sectional shelf unit made of plastic has limited mechanical strength, which affects the load capacity negatively.

Additionally, to improve the load capacity, the unit shelves have a solid or honeycomb structure that does not allow for saving space when the disassembled components are packed for storage in a warehouse or for shipping.

Sectional shelf units made of metal and comprising shelves and uprights made of sheet metal are also present on the market.

The greatest advantage of a metal sectional shelf unit consists in its adequate load capacity.

Moreover, the shelves generally have a hollow structure that allows for housing many components therein, including for example uprights and feet, thereby significantly reducing the overall dimensions of the packaging.

However, at the same time, a metal sectional shelf unit entails complex assembly and disassembly requiring small metal parts, including screws, washers, bolts, lock nuts, etc., and specific tools such as screwdrivers, wrenches, Allen wrenches, etc.

Furthermore, the corners and edges of the sheet-metal components are generally sharp and making them safe requires additional work procedures that complicate the production process and result in a more costly final product.

The task of the present invention is therefore to eliminate the drawbacks of the prior art cited hereinabove.

SUMMARY

Within the scope of this task, an aim of the invention is to realise a kit for assembling a shelf unit that offers an adequate load capacity, is easily assembled and disassembled, safe for the user when in use and during the assembly and disassembly stages and that can offer reduced dimensions of the packaging of the disassembled components.

The task, as well as these and other aims, according to the invention, are achieved by realizing a kit for the assembly of a shelf unit characterized in that it comprises at least one metal shelf that exhibits at least one through hole, at least one upright made of plastic and comprising at least one first part having a male connecting end and at least one second part having a female connecting end, which can be coupled with said male connecting end so as to connect said first and second parts of the upright to each other, and at least one plastic insert exhibiting at least one through hole and provided with means for engagement with said upright, said first and second upright parts being configured to be slipped into said hole of the insert from opposite sides thereof so as to connect them to each other, said insert being configured so as to achieve an interlocked state in one end of said shelf in which the insert hole is aligned with the hole in the shelf and the engagement means is arranged so as to be tightly fastened between said female connecting end and said male connecting end when said first and second upright parts are connected to each other.

Additional characteristics of the present invention are also defined in the claims that follow.

The invention advantageously combines the typical advantages of a shelf unit made of plastic, including easy assembly and user safety, with the advantages of a shelf unit made of metal, including high load capacity and reduced dimensions of the packaging.

BRIEF DESCRIPTION OF THE DRAWINGS

Further characteristics and advantages will emerge more clearly from the detailed description of the shelf unit according to the invention, as illustrated by way of indicative example in the accompanying figures, in which.

DETAILED DESCRIPTION

Figure 1:
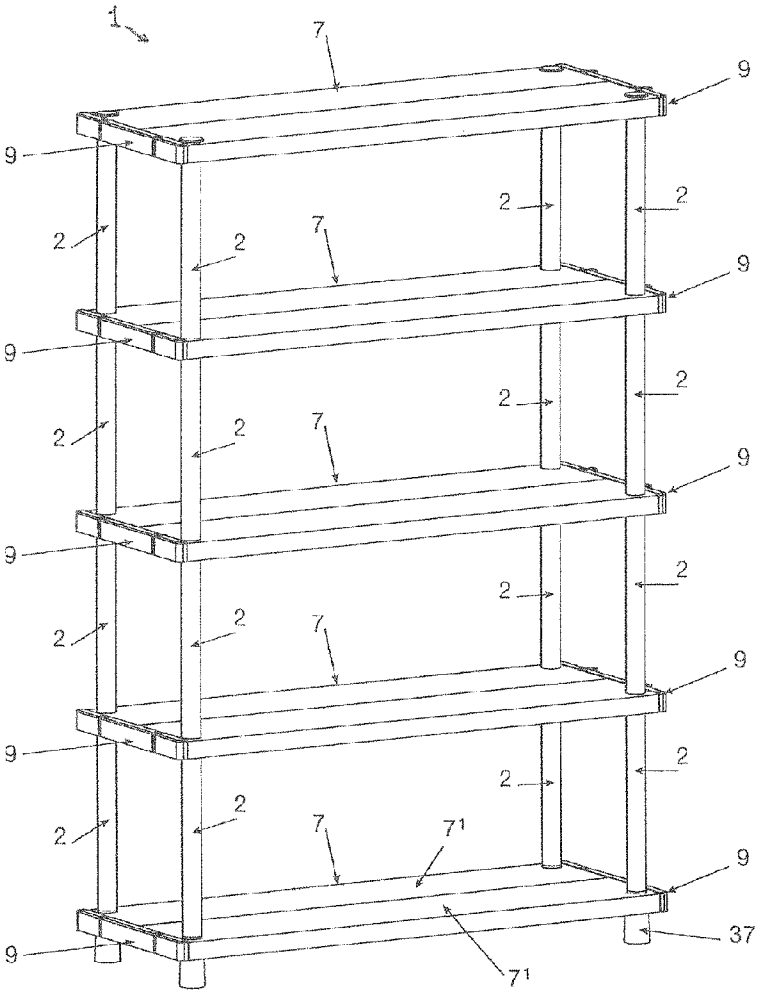
FIG. 1 is a perspective view of the assembled shelf unit.
Figure 2:
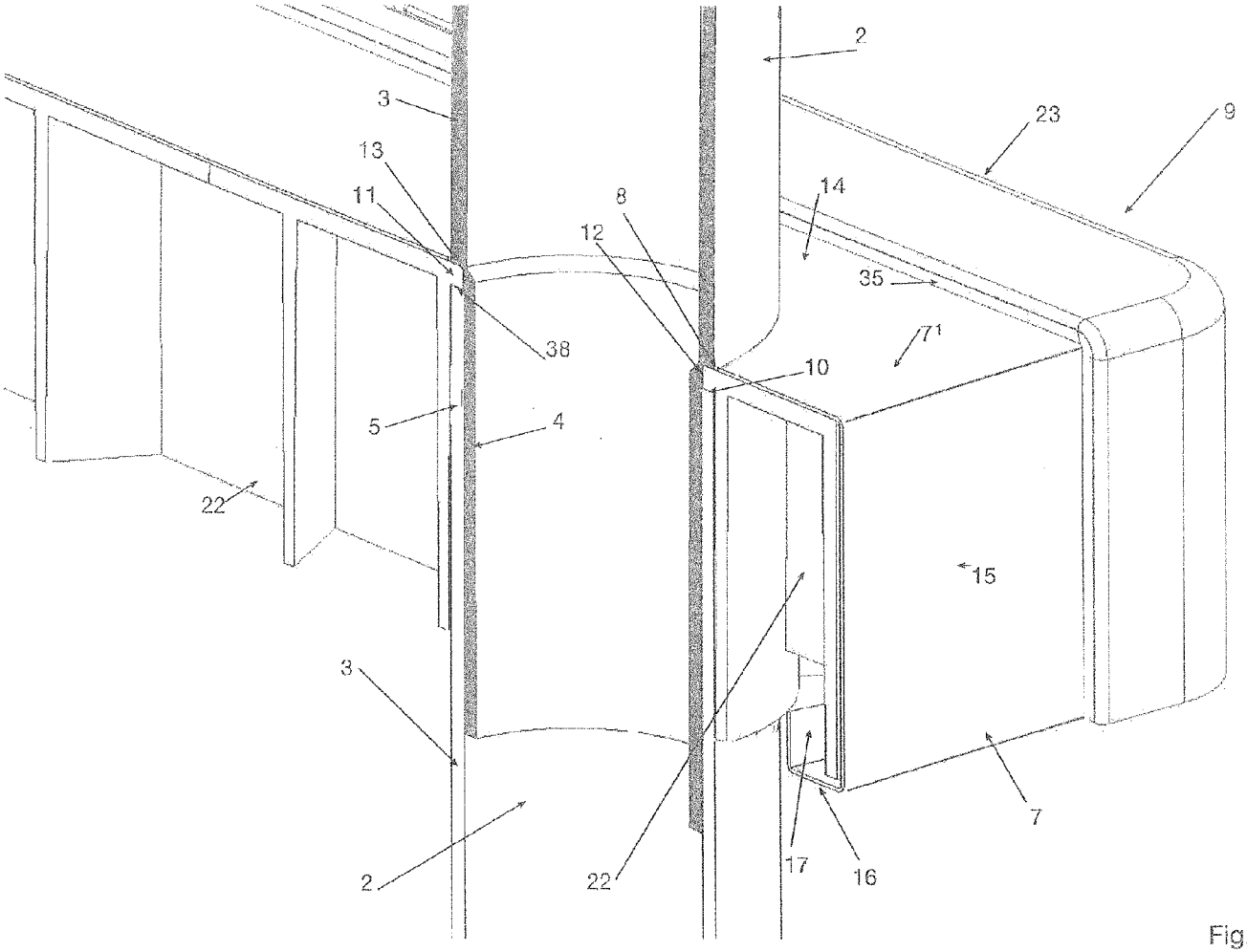
FIG. 2 is a detail drawing of the rigid connection between the upright and the insert.
Figure 3:
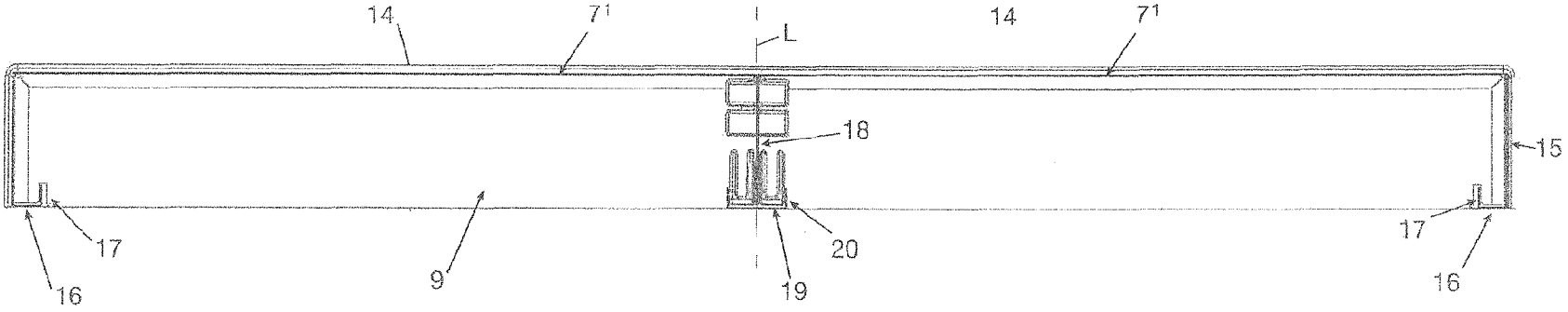
FIG. 3 is a rear view of the insert positioned in two shelves that are side by side with each other.
Figure 4:
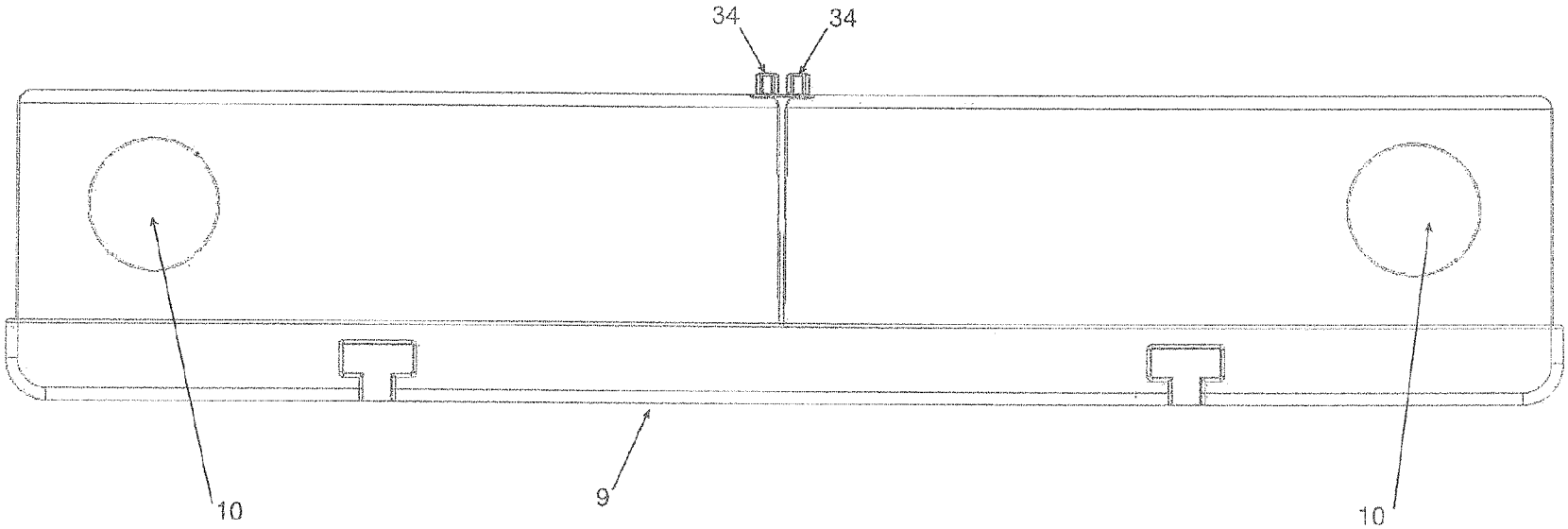
FIG. 4 is a plane view of the insert.
Figure 5:
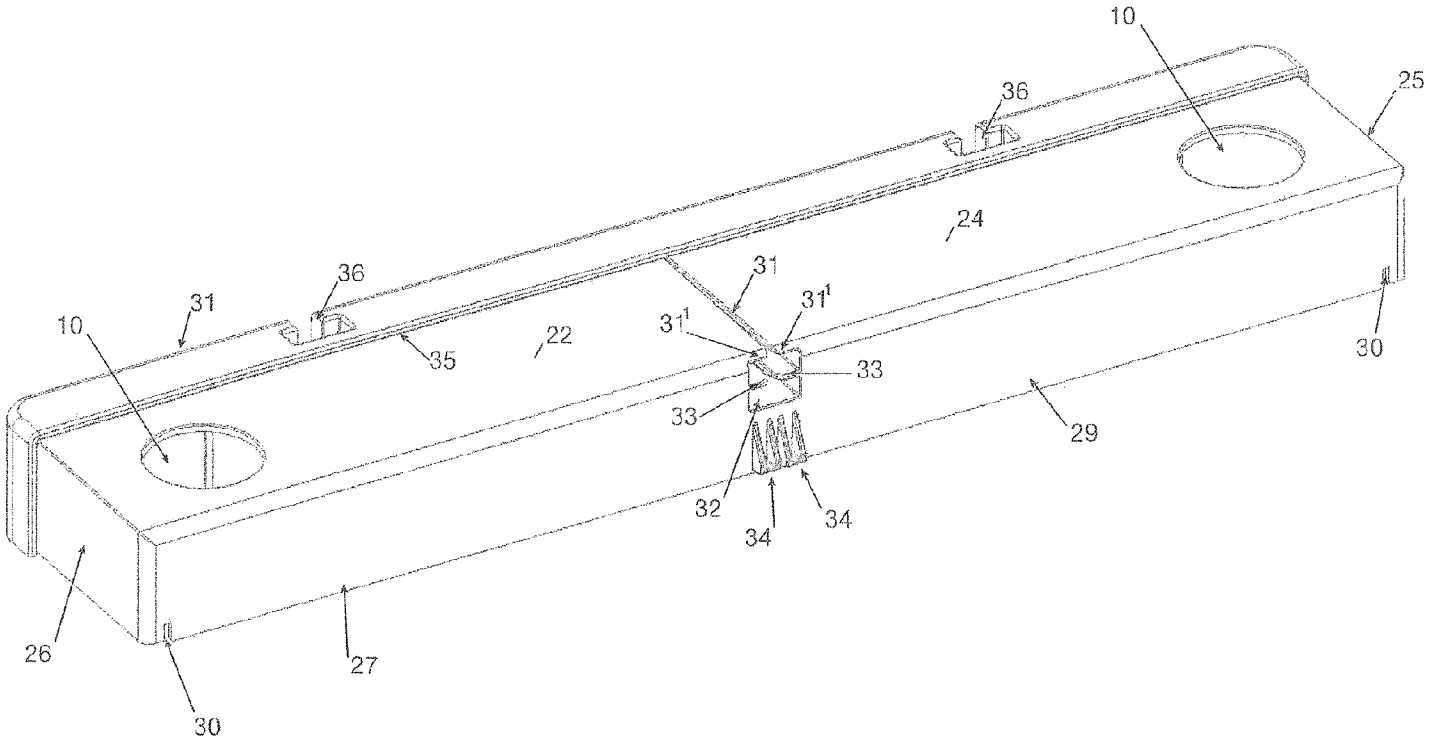
FIG. 5 is a perspective view of the insert from above.
Figure 6:
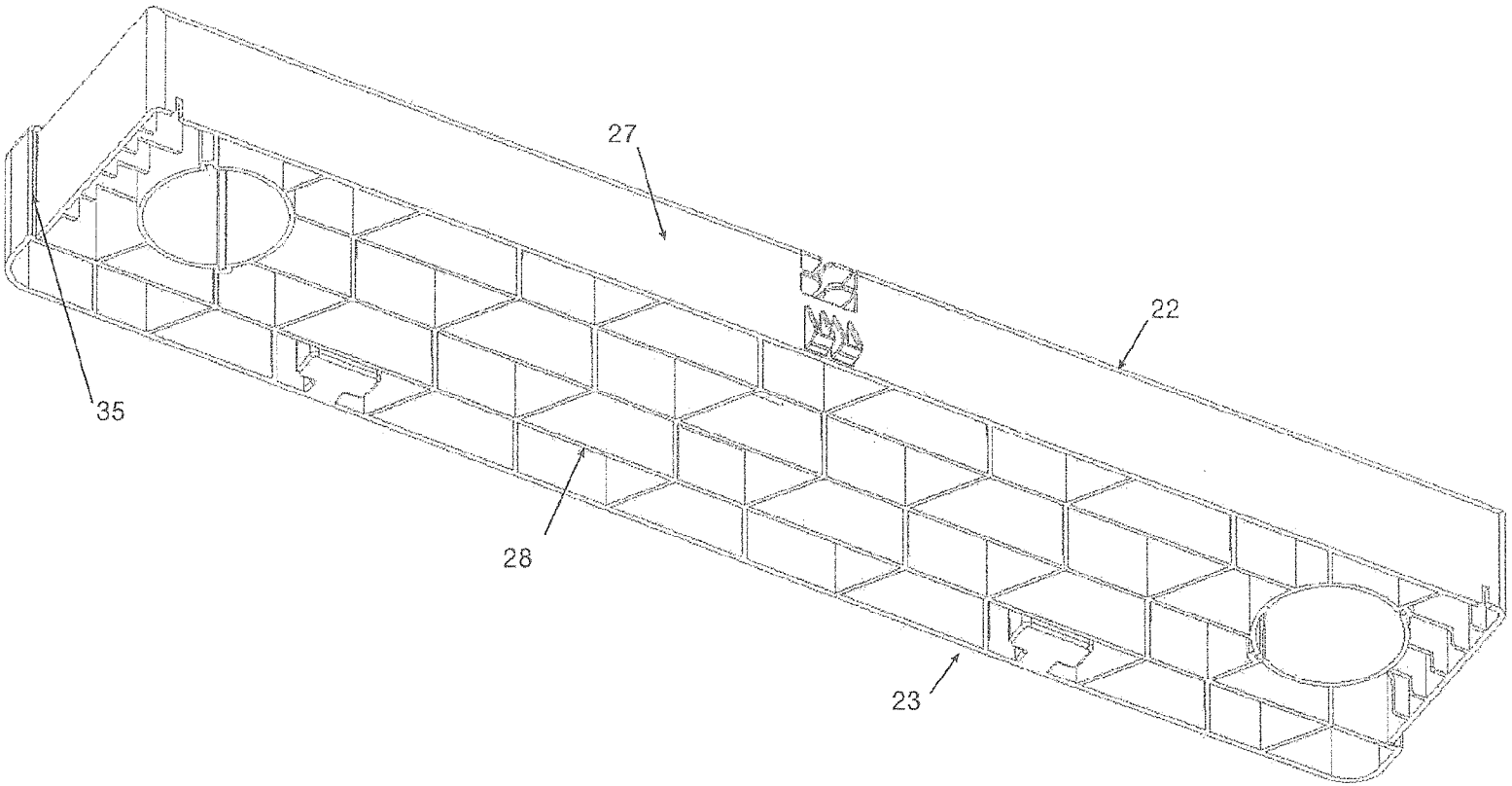
FIG. 6 is a perspective view of the insert from below.
Figure 7:
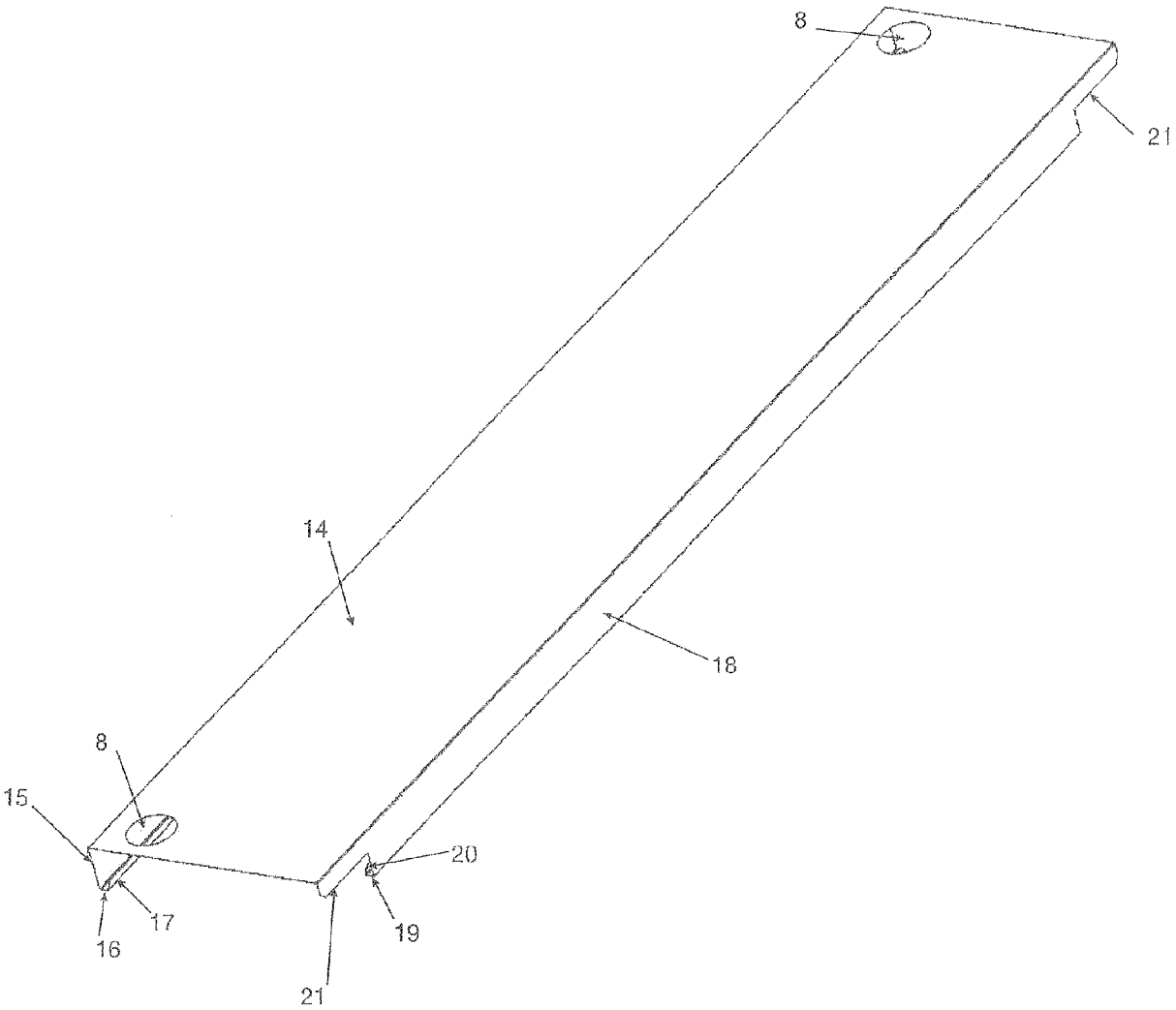
FIG. 7 is a perspective view of one of the two identical sections constituting the shelf of the shelf unit.
Figure 8:
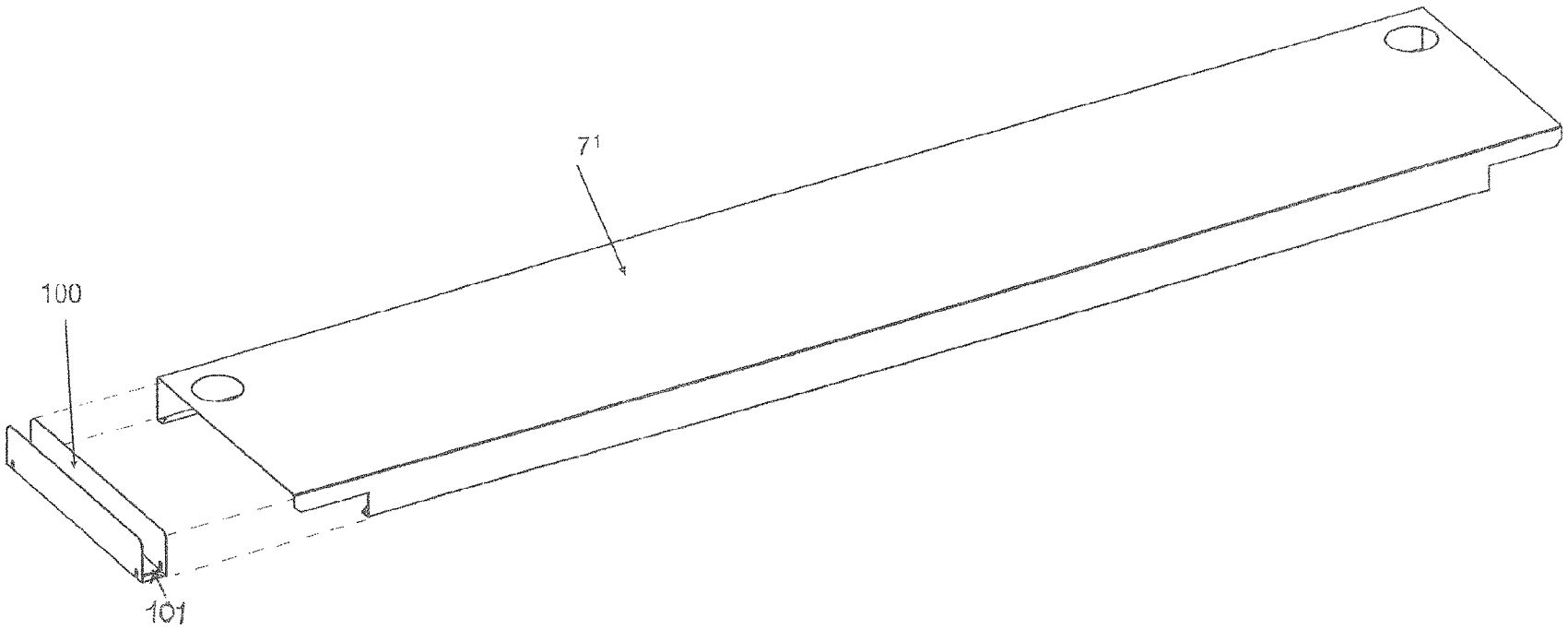
FIGS. 8 and 9 show a disassembled stiffening section and the stiffening section applied to a section that makes up the shelf, respectively.
Figure 9:
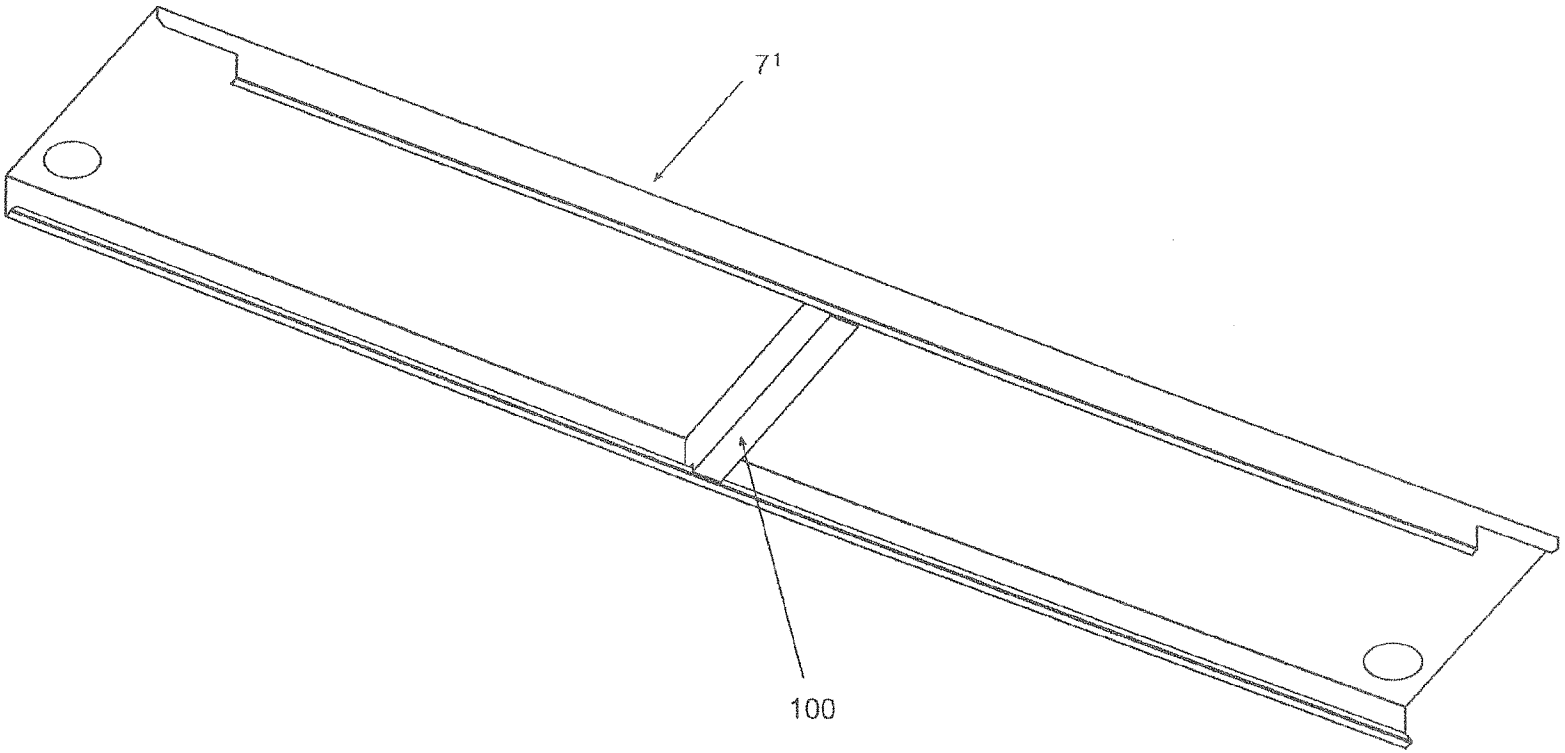

With reference to the figures cited, a kit for assembling a shelf unit is illustrated and generically indicated by the reference number 1.

The essential elements of the kit consist of a plastic upright 2, a metal shelf 7 and a plastic insert 9 for securing the shelf 7 to the upright 2.

The shelf unit that can be obtained from the kit has a minimum configuration that is expandable as desired and it comprises four uprights 2, one shelf 7 and two inserts 9 that can be interlocked at the ends of the shelf 7 so as to secure it to the four uprights 2.

The shelf 7 can be made up of one or more longitudinal sections 7' made of shaped sheet metal and exhibiting at least one through hole 8 that is specifically cylindrical in shape.

In the case of the shelf unit illustrated solely by way of example in FIG. 1, each one of the five shelves 7 is formed by two sections 7', 7' that are side by side and joined as we shall see below, and each section 7' exhibits two holes 8.

The section 7' has an open cross-section and exhibits a longitudinal load plane 14, at least a first longitudinal flank 15 that extends perpendicularly from a longitudinal edge of the load plane 14, a first longitudinal tab 16 that extends perpendicularly from a longitudinal edge of the first flank 15 from the side facing the load plane 14, and a second longitudinal tab 17 that extends perpendicularly from a longitudinal edge of the first tab 16 from the side facing the first flank 15. Each hole 8 is provided at the load plane 14.

Furthermore, the section 7' exhibits a second longitudinal flank 18 that extends perpendicularly from the other longitudinal edge of the load plane 14, a third longitudinal tab 19 that extends perpendicularly from a longitudinal edge of the second flank 18 from the side facing the load plane 14, and a fourth longitudinal tab 20 that extends perpendicularly from a longitudinal edge of the third tab 19 from the side facing the second flank 18.

The first longitudinal flank 15 and the second longitudinal flank 18 are of the same width, the first longitudinal tab 16 and the third longitudinal tab 19 are of the same width, and thus the second longitudinal tab 17 and the fourth longitudinal tab 20 are also of the same width.

In the case of the specific shelf unit illustrated solely by way of example in FIG. 1, in which the shelf 7 is formed by two sections 7' that are side by side with the second flanks 18 thereof perfectly matched, for reasons that will be clearer herein below the third tab 19 and the fourth tab 20 have a missing portion 21 at at least one end of the section 7', and particularly at both ends of the section 7', said missing portion 21 being longitudinally extended for a length no less than the depth of insertion of the insert 9 in the corresponding end of the shelf 7.

Lastly, each longitudinal section 7' can be stiffened so as to improve its flexural and torsional strength by means of at least one metal stiffening section 100 provided in the kit, for example a longitudinal section made of sheet metal with a U-shaped open cross section and that can be arranged transversely in the longitudinal compartment delimited by the open cross section of the section 7'. This stiffening section has for example, at the ends thereof, special slots 101 shaped for interlocking with the second tab 17 and the fourth tab 20 of the section 7'.

The upright 2 is formed by a number of longitudinal parts 3 that are identical to each other and cylindrical and tubular in shape.

The upright 2 specifically comprises at least a first longitudinal part 3 having a male connecting end 4 and at least a second longitudinal part 3 having a female connecting end 5, which can be coupled with the male connecting end 4 of the first part 3 of the upright 2.

More precisely, each part 3 of the upright 2 has one male connecting end 4 and one female connecting end 5, which is of a shape complementary to the male connecting end 4 in such a manner as to enable the joining in succession of the number of parts 3 needed to define the desired length for the upright 2.

The male connecting end 4 is defined by an end tract of the part 3 having a reduced inside and outside diameter. The outside diameter of the male connecting end 4 is substantially equal to the inside diameter of the female connecting end 5.

The base of the male connecting end 4 forms a shoulder 13 external to the part 3.

The upright 2 can be constructed with a varying number of parts 3 as desired according to the number of shelves 7 provided.

In the case of the shelf unit illustrated solely by way of example in FIG. 1, each one of the four uprights 2 comprises four parts 3.

A support foot 37 for resting on the ground is provided for the base end of the upright 2, just as an end piece (not shown) is provided for the top end of the upright 2.

The support foot 37 and the end piece preferably have a connection system for connection to the part 3 of the upright 2 which is identical to the connection system provided between two parts 3 of the upright 2.

The plastic insert 9, preferably with a honeycomb structure, exhibits at least one through hole 10, specifically of a cylindrical shape, and engagement means 11 for engagement with the upright 2.

In the case of the shelf unit illustrated solely by way of example in FIG. 1, each insert 9 exhibits two holes 10.

The insert 9 is configured so as to achieve an interlocked state in one end of the shelf 7, in which the hole 10 in the insert 9 is aligned with hole 8 in the shelf 7 and the engagement means 11 are arranged so as to be tightly fastened between the female connecting end 5 and the male connecting end 4 of the two parts 3.

The engagement means 11 comprises a ridge 12 that radially projects inside the hole 10 in the insert 9.

The ridge 12, which is annular in shape, circumscribes a cylindrical passage coaxial with the cylindrical hole 10 and it is positioned at one end of the cylindrical hole 10 in the insert 9.

The diameter of the hole 10 in the insert 9 is substantially equal to the maximum outside diameter of the part 3.

The diameter of the cylindrical passage circumscribed by the ridge 12 is smaller than the maximum outside diameter of the part 3 and larger than or substantially equal to the minimum outside diameter of the part 3.

Obviously, the diameter of the hole 8 in the shelf 7 is no smaller than or preferably equal to the diameter of the cylindrical passage circumscribed by the ridge 12 so as not to hinder engagement of the male connecting end 4 with the female connecting end 5.

The insert 9 comprises a first interlocking portion 22 for interlocking in the end of the shelf 7 and a second portion 23 that can be positioned externally to the end of the shelf 7.

The first interlocking portion 22 is predisposed with a parallelepiped shape that can be coupled to the transverse section of the shelf 7.

In the case of the shelf unit illustrated solely by way of example in FIG. 1, in which the shelf 7 is formed by two sections 7' that are side by side with the second flanks 18 thereof perfectly matched, the first interlocking portion 22 specifically has a first face 24 suitable for being set opposite the load plane 14 of the two sections 7', a second face 25 perpendicular to the first face 24 and suitable for being set opposite the first flank 15 of a section 7', a third face 26 parallel to the second face 25 and suitable for being set opposite the first flank 15 of the other section 7', a fourth face 27 parallel to the first face 24 and suitable for being set opposite the first tab 16 and the third tab 19 of the sections 7', a fifth face 28 perpendicular to the preceding ones and proximal to the second portion 23 of the insert 9, and a sixth face 29 parallel to the fifth face 28 and distal from the second portion 23 of the insert 9. The through hole 10 extends between the first face 24 and the fourth face 27 with the axis perpendicular to the plane in which the faces 26, 27 lie.

Coupling slots 30 for the second tab 17 of each section 7' are provided on the fourth face 27 of the first portion 22 of the insert 9.

The width of the slot 30 is substantially equal to the thickness of the sheet metal of the section 7' and the slot extends in depth in a direction perpendicular to the fourth face 27 to an extent that is no less than the width of the second tab 17.

In the case of the shelf unit illustrated solely by way of example in FIG. 1, in which the shelf 7 is formed by two sections 7' that are side by side with the second flanks 18 thereof perfectly matched, the first portion 22 of the insert 9 further comprises, at the first face 24 thereof, an additional fastening slot 31 for the two second side-by-side flanks 18 of the two sections 7'.

The width of the slot 31 is constant and substantially equal to twice the thickness of the sheet metal of the section 7' and the slot extends longitudinally in a direction perpendicular to the fifth and sixth face 28 and 29 and through the entire first face 24.

The slot 31 extends in depth in a direction perpendicular to the first face 24 and communicates with an internal chamber 32 of the first portion 22 of the insert 9 extending longitudinally for the entire length of the slot 31 and as far as the sixth face 29 of the first portion 22 of the insert 9.

Two longitudinal coplanar tabs 33 protrude in the chamber 32, said tabs 33 being suitable for consolidating the mutual fastening between the two second side-by-side flanks 18 of the two sections 7'. The fastening tabs 33 are oriented parallel with the first face 24 and they are made as an integral piece with the body of the first portion 22 of the insert 9.

The longitudinal edges of the fastening tabs 33 delimit a longitudinal gap of a constant width substantially equal to twice the thickness of the sheet metal of the section 7'.

Two adjacent formations 34 protrude from the sixth face 29 of the first part 22 of the insert 9, each formation having a shape suitable for coupling with the compartment delimited by the second flank 18, the third tab 19 and the fourth tab 20 of a corresponding section 7'.

Between the two formations 34, there is a gap of a constant width substantially equal to twice the thickness of the sheet metal of the section 7'.

The gap between the fastening tabs 33, the gap between the two formations 34 and the gap between the longitudinal edges 31 defining the slot 31 are found in the same central plane L of the insert 9 parallel to the second and third faces 25 and 26 of the first part 22 of the insert 9.

The second portion 23 of the insert 9 has a shoulder 35 for engaging the edge of the end of the section 7'.

The height of the shoulder 35 is no less than the thickness of the sheet metal of the section 7' so as to completely cover the edge of the end of the section 7'.

As shown, the second portion 23 of the insert 9 can comprise one or more specially shaped seats 36 for interconnection with an insert 9 associated with a shelf 7 of an adjacent shelf unit by means of special dowels (not shown).

Assembly of the shelf unit appearing in FIG. 1 takes place as follows.

The sections 7' are brought side by side with the second flanks 18 thereof perfectly matched and an insert 9 is introduced in each end of the shelf 7.

The load plane 14 of the two sections 7', the first flank 15 of the two sections 7', the first tab 16 of the two sections 7' and the second tab 17 of the two sections 7' function as guides for the introduction of the insert 9.

Specifically, the face 24 slides along the internal side of the load plane 14 of the two sections 7', the faces 25 and 26 slide along the internal side of the first flank 15 of the two sections 7', the face 29 slides along the internal side of the first tab 16 of the two sections 7', and each slot 30 slides along a corresponding second tab 17 of the two sections 7'.

In this stage, the missing portion 21 makes insertion of the insert 9 possible, as it is not obstructed by the third tab 19 or by the fourth tab 20 of the sections 7'.

During insertion of the insert 9, the slot 31 slides, hugging the second flanks 18, tightly fastening them one against the other, and as the insertion of the insert 9 reaches completion, each formation 34 engages the compartment delimited by the second flank 18, the third tab 19 and the fourth tab 20 of a corresponding section 7'.

Insertion of the insert 9 is completed when the edge of the end of the shelf 7 abuts against the shoulder 35. In this final position of the insert 9, the hole 10 is aligned with the hole 8.

The insert 9 thus fastens the two sections 7' to each other and gives the end of the shelf 7 the solidity required to constrain the shelf 7 to the upright 2.

It should be noted that owing to the locking of the second tab 17 by the slot 30, and the locking of the third tab 19 and the fourth tab 20 by the formation 34, the insert 9 can be separated from the end of the shelf 7 by simply using an extraction manoeuvre that is the reverse of the insertion manoeuvre described above.

To constrain the shelf 7 to the upright 2, one proceeds by slipping the female connecting end 5 of a part 3 of the upright 2 into the hole 10, from the side opposite the hole 8, until the tip 38 of the female connecting end 5 is engaged against one side of the ridge 12.

One then proceeds by slipping the male connecting end 4 of the other part 3 of the upright 2 into the hole 10, from the side of the hole 8, sliding the male connecting end 4 through the cylindrical passage circumscribed by the ridge 12 until it is inserted in the hole 10 and thus engaged with the female connecting end 5. Insertion is completed when the base of the male connecting end 4 defining the shoulder 13 is engaged against the other side of the ridge 12.

Essentially, the ridge 12 thus remains tightly fastened between the tip 38 of the female connecting end 5 and the base of the male connecting end 4.

This procedure is repeated at the four corners of each shelf 7 taking care to replace one part 3 with the support foot 37 on the lowest shelf, and one part 3 with the end piece on the highest shelf.

To sum up, the kit according to the present invention makes it possible to assemble a shelf unit that combines the strong points of a product made entirely of plastic, among which ease of assembly and user safety, with the strong points of a product made entirely of metal, among which high load capacity and reduced dimensions of the packaged components.

In practice, the dimensions can vary, according to requirements and the state of the art.

The invention claimed is:

1. A kit for assembling a shelf unit, comprising:

at least one metal shelf that exhibits at least one through hole, at least one upright made of plastic and comprising:

at least one first part having a male connecting end; and at least one second part having a female connecting end, which can be coupled with said male connecting end so as to connect said first and second parts of the upright to each other;

at least one plastic insert exhibiting at least one through hole and provided with an engagement connector to engage with said upright, comprising:

a first interlocking portion for interlocking in an end of said shelf; and a second portion that can be positioned externally to said end of the shelf, wherein said first interlocking portion being provided with said at least one hole in the insert and being predisposed with a parallelepiped shape that can be coupled to a transverse section of said shelf;

at least one longitudinal section made of sheet metal and having an open cross section, said section having a longitudinal load plane where there is provided said at least one hole in the shelf;

at least a first longitudinal flank that extends perpendicularly from a longitudinal edge of said load plane;

a first longitudinal tab that extends perpendicularly from a longitudinal edge of said first flank from the side facing said load plane;

a second longitudinal tab that extends perpendicularly from a longitudinal edge of said first tab from the side facing said first flank;

a second longitudinal flank that extends perpendicularly from another longitudinal edge of the load plane;

a third longitudinal tab that extends perpendicularly from a longitudinal edge of the second flank from the side facing the load plane;

a fourth longitudinal tab that extends perpendicularly from a longitudinal edge of the third tab from the side facing the second flank; and said first portion comprises at least one coupling slot for said second tab on at least one face of the first portion which can be set opposite said first tab, wherein said first and second parts of the upright being configured to be slipped into said hole of the insert from opposite sides thereof so as to connect the first and second parts to each other, wherein said insert being configured so as to achieve an interlocked state in one end of said shelf in which the hole in the insert is aligned with the hole in the shelf, and wherein the engagement connector is arranged so as to be tightly fastened between said female connecting end and said male connecting end when said first and second parts of the upright are connected to each other.

2. The kit for assembling a shelf unit according to claim 1, wherein said engagement connector comprises a ridge that radially projects inside said hole in said insert.

3. The kit for assembling a shelf unit according to claim 2, wherein said ridge is positioned at one end of said hole in said insert.

4. The kit for assembling a shelf unit according to claim 2, wherein said ridge extends along the inside perimeter of said hole in the insert and exhibits one side for engaging a base of said male connecting end and one side for engaging a tip of said female connecting end.

5. The kit for assembling a shelf unit according to claim 1, wherein said second portion has a shoulder for engaging the edge of said end of the shelf, the height of said shoulder being no less than the thickness of the wall of said longitudinal section so as to completely cover the edge of the end thereof.

6. The kit for assembling a shelf unit according to claim 1, wherein said second portion of the insert comprises one or more shaped seats for interconnection with another insert.

7. The kit for assembling a shelf unit according to claim 1, wherein said insert has a honeycomb structure.

8. The kit for assembling a shelf unit according to claim 1, wherein said first and second parts of the upright are tubular and cylindrical in shape.

9. The kit for assembling a shelf unit according to claim 1, wherein said third tab and said fourth tab have a missing portion at at least one end of the longitudinal section, said missing portion being longitudinally extended for a length no less than the depth of insertion of said insert in said end of said shelf.

10. The kit for assembling a shelf unit according to claim 9, wherein said first portion comprises a slot on the at one face that can be set opposite said load plane, the width of said slot being substantially equal to twice the thickness of said longitudinal section for tightly fastening two sections that are side by side.

11. The kit for assembling a shelf unit according to claim 10, wherein said first portion comprises two adjacent protruding formations, each formation having a shape suitable for coupling with a compartment delimited by the second flank, the third tab and the fourth tab of a corresponding section.

12. The kit for assembling a shelf unit according to claim 1, wherein further comprising at least one metal stiffening section and that can be arranged transversely in a longitudinal compartment delimited by an open cross section of said at least one longitudinal section constituting said shelf.

* * * * *